US007140185B2

(12) United States Patent
Burd

(10) Patent No.: US 7,140,185 B2
(45) Date of Patent: Nov. 28, 2006

(54) HEATSHIELDED ARTICLE

(75) Inventor: Steven W. Burd, Cheshire, CT (US)

(73) Assignee: United Technologies Corporation, Hartford, CT (US)

( * ) Notice: Subject to any disclaimer, the term of this patent is extended or adjusted under 35 U.S.C. 154(b) by 59 days.

(21) Appl. No.: 10/890,470

(22) Filed: Jul. 12, 2004

(65) Prior Publication Data

US 2006/0005543 A1 Jan. 12, 2006

(51) Int. Cl.
*F02C 1/00* (2006.01)
*F02G 3/00* (2006.01)

(52) U.S. Cl. ..... 60/752; 60/754; 110/336

(58) Field of Classification Search ..... 60/752–760; 110/336–339
See application file for complete search history.

(56) References Cited

U.S. PATENT DOCUMENTS

| | | | | | |
|---|---|---|---|---|---|
| 4,422,300 | A * | 12/1983 | Dierberger et al. | ..... | 60/757 |
| RE32,121 | E | 4/1986 | Gupta et al. | ..... | 428/656 |
| 4,585,481 | A | 4/1986 | Gupta et al. | ..... | 106/14.05 |
| 4,861,618 | A | 8/1989 | Vine et al. | ..... | 427/34 |
| 5,144,793 | A * | 9/1992 | Able et al. | ..... | 60/800 |
| 5,253,471 | A * | 10/1993 | Richardson | ..... | 60/804 |
| 5,333,443 | A * | 8/1994 | Halila | ..... | 60/796 |
| 5,363,643 | A * | 11/1994 | Halila | ..... | 60/796 |
| 5,435,139 | A * | 7/1995 | Pidcock et al. | ..... | 60/757 |
| 5,480,162 | A * | 1/1996 | Beeman, Jr. | ..... | 277/355 |
| 5,509,270 | A * | 4/1996 | Pearce et al. | ..... | 60/740 |
| 5,524,438 | A * | 6/1996 | Johnson et al. | ..... | 60/747 |
| 5,542,246 | A * | 8/1996 | Johnson et al. | ..... | 60/804 |
| 5,737,922 | A * | 4/1998 | Schoenman et al. | ..... | 60/752 |
| 5,758,503 | A * | 6/1998 | DuBell et al. | ..... | 60/752 |
| 5,894,732 | A * | 4/1999 | Kwan | ..... | 60/756 |
| 5,974,805 | A * | 11/1999 | Allen | ..... | 60/740 |
| 6,240,731 | B1 | 6/2001 | Hoke et al. | ..... | 60/732 |
| 6,387,456 | B1 | 5/2002 | Eaton, Jr. et al. | ..... | 427/452 |
| 6,408,628 | B1 * | 6/2002 | Pidcock et al. | ..... | 60/752 |
| 6,412,272 | B1 * | 7/2002 | Titterton et al. | ..... | 60/39.37 |
| 6,497,105 | B1 * | 12/2002 | Stastny | ..... | 60/796 |
| 6,589,677 | B1 | 7/2003 | Sun et al. | ..... | 428/698 |
| 6,606,861 | B1 | 8/2003 | Snyder | ..... | 60/752 |
| 6,675,586 | B1 * | 1/2004 | Maghon | ..... | 60/796 |
| 6,701,714 | B1 | 3/2004 | Burd et al. | ..... | 60/752 |
| 6,810,673 | B1 * | 11/2004 | Snyder | ..... | 60/752 |
| 2003/0182942 | A1 * | 10/2003 | Gerendas | ..... | 60/752 |
| 2005/0022531 | A1 * | 2/2005 | Burd | ..... | 60/752 |
| 2005/0086940 | A1 * | 4/2005 | Coughlan et al. | ..... | 60/752 |

OTHER PUBLICATIONS

Advanced Design Floatwall™ Combustor Liner, (Pratt & Whitney Gas Turbine Seminar) vol. 1, May 1990, (1 page document).
U.S. Appl. No. 10/632,046, filed Jul. 31, 2003, Burd.

* cited by examiner

*Primary Examiner*—William H. Rodriguez
(74) *Attorney, Agent, or Firm*—Kenneth C. Baran

(57) ABSTRACT

A heatshielded article includes a support 18 and at least one heatshield 20 secured adjacent to the support. The heatshield includes a shield portion 28 spaced from the support. The shield portion includes a hot side 30 and an uncoated cold side 32. A projection projects from an origin 36 at the shield portion to a terminus 38 remote from the shield portion. The terminus includes a protective coating 64 along at least a portion of its length.

8 Claims, 4 Drawing Sheets

FIG.2
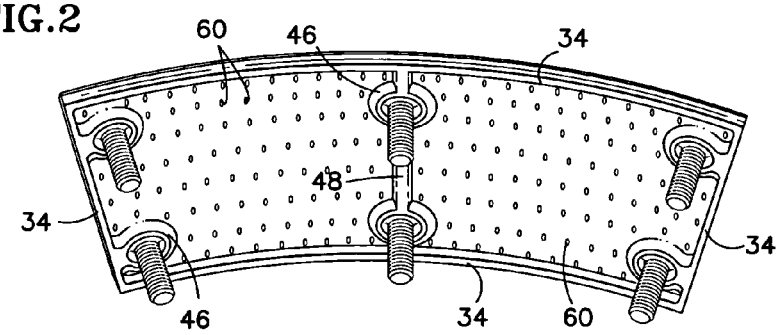
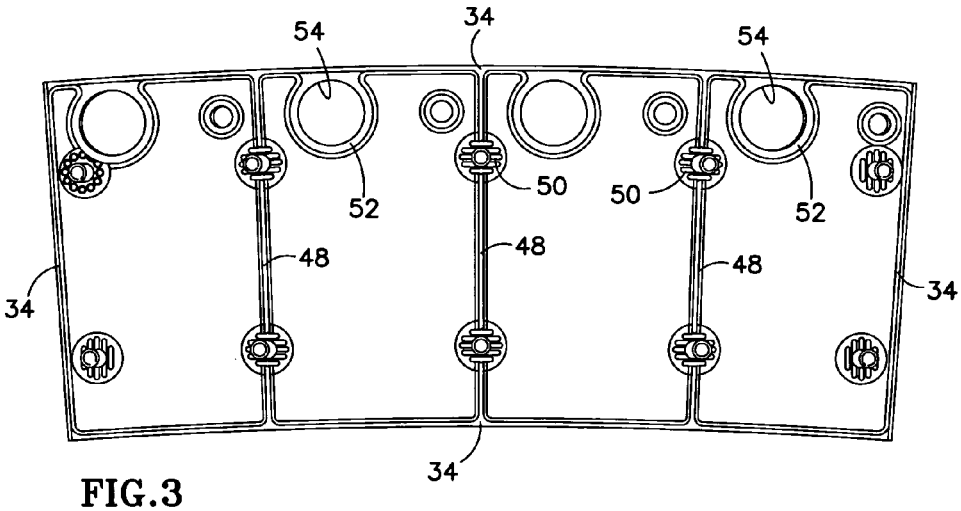
FIG.3
FIG.4
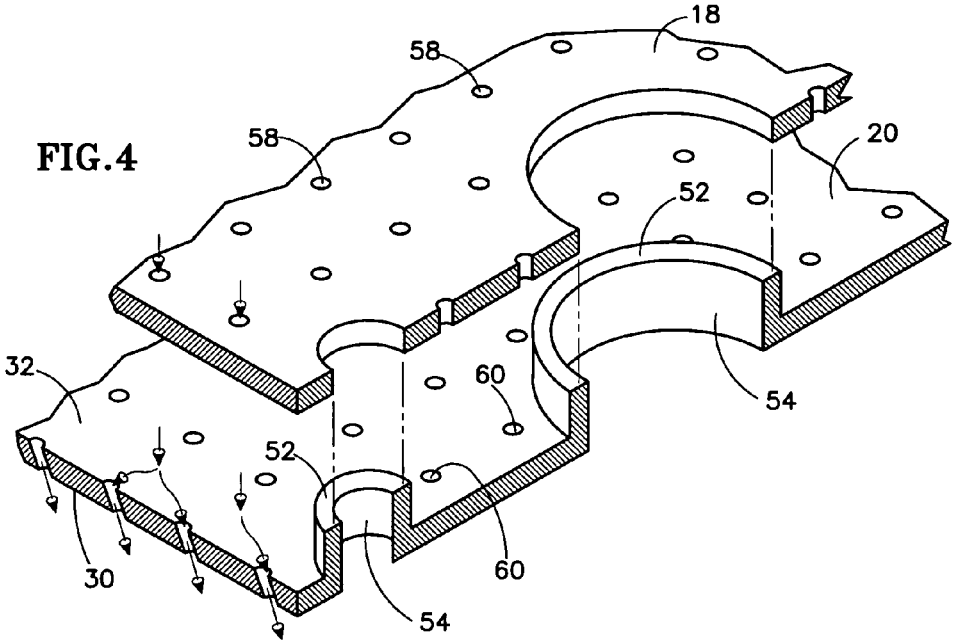

HEATSHIELDED ARTICLE

TECHNICAL FIELD

This invention relates to heatshielded articles, such as a combustion chamber for a gas turbine engine, and to heatshields for such articles.

BACKGROUND OF THE INVENTION

A typical gas turbine engine includes one or more compressors, a combustor, and one or more turbines each connected by a shaft to an associated compressor. In most modern engines the combustor is an annular combustor in which a radially inner liner and a radially outer liner cooperate with each other to define an annular combustion chamber. During operation, a high temperature stream of gaseous combustion products flows through the combustion chamber. Because of the high temperatures, the liner surfaces that face the hot gases are susceptible to damage. It is, therefore, customary to protect those surfaces with a film of coolant, a protective coating, a heatshield, or some combination thereof.

One type of combustor is referred to as a thermally decoupled combustor; one type of thermally decoupled combustor is referred to as an impingement film cooled combustor. In an annular, impingement film cooled combustor, the inner and outer liners each comprise a support shell and a set of temperature tolerant heatshield panels secured to the shell to protect the shell from the hot combustion gases. A typical heatshield panel has a shield portion whose platform is rectangular or approximately rectangular. When secured to the shell, the shield is oriented substantially parallel to the shell so that one side of the heatshield, referred to as the hot side, faces the hot combustion gases and the other side, referred to as the cold side, faces toward the support shell. One or more threaded studs project from the cold side of each shield. In a fully assembled combustor, the studs penetrate through openings in the shell. Nuts threaded onto the studs attach the heatshield panels to the shell.

A principal advantage of a thermally decoupled combustor is that the heatshield panels can thermally expand and contract independently of each other. This thermal independence improves combustor durability by reducing thermally induced stresses. Examples of impingement film cooled, thermally decoupled combustors may be found in U.S. Pat. Nos. 6,701,714 and 6,606,861.

Various types of projections other than the studs also extend radially toward the shell from the cold side of each shield. These projections, unlike the studs, are not intended to penetrate through the support shell. One example of a non-penetrating projection is a boundary wall extending around the cold side of the shield at or near the shield perimeter. A typical boundary wall has an origin at the shield portion of the heatshield and a terminus remote from the shield. The height of the wall is the distance from the origin to the terminus. The terminus contacts the support shell thereby spacing the shield portion from the shell and defining a substantially sealed, radially narrow coolant chamber between the shell and the cold side of the shield. Alternatively, the height of the wall may be foreshortened over part or all of its length resulting in interrupted contact, or the absence of contact, between the wall terminus and the shell.

An impingement film cooled combustor liner also features numerous impingement holes that perforate the support shell and numerous film holes that perforate the heatshield panels.

The impingement holes discharge a coolant (usually cool air extracted from the engine compressor) into the coolant chamber at high velocity so that the cooling air impinges on the cold side of the heatshield panel to help cool the heatshield. The impinged cooling air then flows through the film holes and forms a coolant film along the hot side of the heatshield.

In a state of the art impingement film cooled combustor, both the support shell and the heatshield panels are made of nickel alloys, although not necessarily the same alloy. In more advanced impingement film cooled combustors, the shell may be made of a nickel alloy and the heatshield panels may be made of a refractory material. Refractory materials include, but are not limited to, molybdenum alloys, ceramics, niobium alloys and metal intermetallic composites.

Despite the advantages of thermally decoupled, impingement film cooled combustors, they are not without certain limitations. For example, it may become apparent during engine development testing, or as a result of field experience, that it would be advisable to divert some of the coolant that would otherwise flow through the film holes in order to use that coolant for other purposes. This could be accomplished by radially foreshortening at least a part of the boundary wall that projects from the cold side of the heatshield panel, thus achieving the desired diversion of coolant from the coolant chamber. Alternatively, product development tests or field experience may suggest the desirability of radially lengthening a foreshortened boundary wall in order to reduce or curtail coolant diversion. These changes can be effected by modifying the tooling used to manufacture the heatshield and/or by revising the specifications that govern heatshield finishing operations such as machining. However introducing such changes can be expensive and complicated for the-engine manufacturer.

Additional limitations might affect advanced combustors that use a nickel alloy support shell and a refractory heatshield, especially at the interface where a heatshield boundary wall or other non-penetrating projection contacts the support shell. Because the refractory heatshield panels are intended to operate at higher temperatures than nickel alloy heatshields, considerable heat can be transferred across the interface where the heatshields contact the shell. This can cause problems such as local oxidation or corrosion of the shell, local excedance of its temperature tolerance or local excedance of its tolerance to temperature gradients. Other problems related to direct contact include detrimental changes in the morphology or microstructure of the shell, changes that may be exacerbated by elevated temperatures.

SUMMARY OF THE INVENTION

It is, therefore, an object of the invention to facilitate simple, cost effective changes to the radial height of the nonpenatrating projections that extend from the cold side of a heatshield panel. It is another object of the invention to mitigate problems arising from heat transfer across the interfaces where the projections contact the support shell or arising from direct contact between dissimilar materials.

According to one embodiment of the invention, a heatshielded article, such as a gas turbine engine combustor, includes a support and a heatshield adjacent to the support. The heatshield has a shield portion spaced from the support. The shield has a hot side and an uncoated cold side. A projection extends from an origin at the shield portion to a terminus remote from the shield portion. The terminus includes a coating along at least a portion of its length.

One advantage of the invention is that the height of the projection can be easily changed by increasing or decreasing the coating thickness. This allows the manufacturer of the heatshield to easily and inexpensively introduce changes into the manufacturing process for producing new heatshields and to easily and inexpensively reoperate previously manufactured heatshields. A second advantage is that the coating can help mitigate problems related to heat transfer or contact between dissimilar materials at the interface where projections on the heatshield contact the support.

These and other objects, advantages and features will become more apparent from the following description of the best mode for carrying out the invention and the accompanying drawings.

BRIEF DESCRIPTION OF THE DRAWINGS

FIGS. 2 and 3 are perspective and plan views respectively showing heatshield panels whose design details differ from those of the heatshields seen in FIG. 1.

FIG. 4 is a magnified, slightly exploded, fragmentary view of the radially outer support shell and a heatshield panel of FIG. 1.

BEST MODE FOR CARRYING OUT THE INVENTION

Figures 1, 1A:
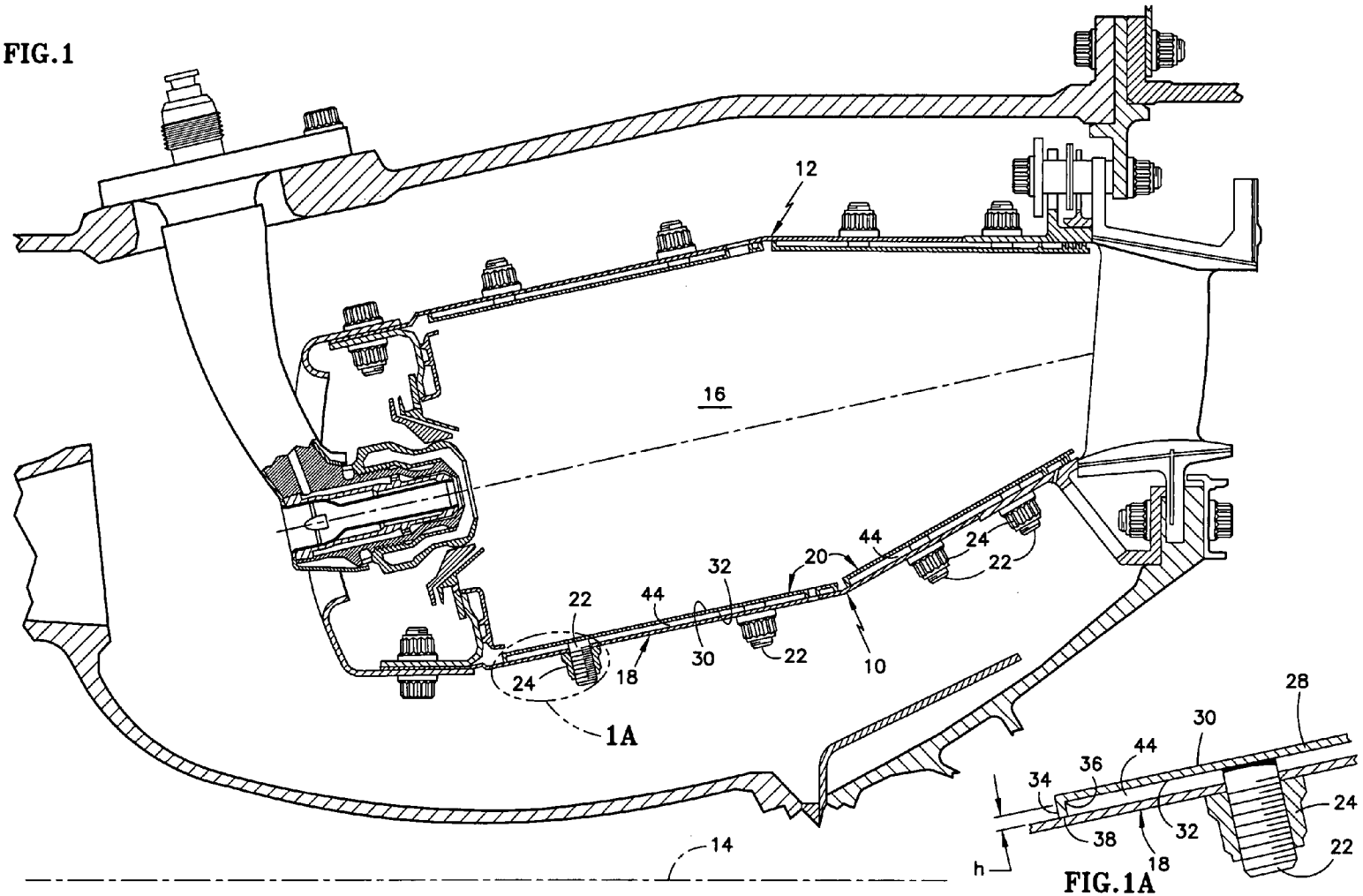
FIG. 1 is a cross sectional side elevation view of a thermally decoupled, impingement film cooled combustor for a turbine engine showing radially inner and outer support shells with heatshield panels attached thereto.
FIG. 1A is an enlarged view of the area 1A of FIG. 1.

Referring to FIGS. 1 and 1A, an annular, impingement film cooled combustor for a turbine engine includes radially inner and outer liners 10, 12. Each liner circumscribes an engine axis 14. The liners cooperate with each other to define an annular combustion chamber 16.

The inner and outer liners are similar, and it will suffice to describe only the inner liner in greater detail. The inner liner comprises a support shell 18 and a set of axially and circumferentially distributed heatshield panels 20. Threaded studs 22, project from one side of each heatshield and penetrate through openings in the shell. A nut 24 threaded onto each stud secures each heatshield to the shell so that a shield portion 28 of the heatshield is oriented substantially parallel to the shell. When thus assembled, one side of the shield, referred to as the hot side 30, faces the combustion chamber 16. The other side, referred to as the cold side 32, faces the support shell.

Projections other than the studs may also extend radially toward the support shell from the cold side of each shield. These other projections are referred to as nonpenetrating projections because, unlike the studs 22, they are not intended to penetrate through the shell 18. These nonpenetrating projections may take the form of a boundary wall 34 that extends lengthwisely around all four sides of each shield at or near the shield perimeter. The boundary wall projects radially from a wall origin 36 at the shield portion 28 of the heatshield panel to a terminus 38 remote from the shield. The boundary wall has a radial height h. In FIGS. 1 and 1A, the wall contacts the shell along the entire length of the wall thereby spacing the shield portion from the shell and defining a coolant chamber 44 of height h. However the boundary wall may be radially foreshortened over part of its length resulting in interrupted contact between the wall and the shell. The wall may also be radially foreshortened over its entire length, resulting in the absence of contact between the wall and the shell. Such a configuration is described in more detail in commonly owned patent application Ser. No. 10/632,046.

Other types of nonpenetrating projections may also be present. These include collars 46 circumscribing the studs (FIG. 2), internal ribs 48 (FIGS. 2 and 3), radiator fins or standoffs 50 (FIG. 3), and raised rims 52 (FIGS. 3 and 4) circumscribing large diameter holes 54 that may be present on some heatshield panels for admitting combustion air into the combustion chamber. Other types of nonpenetrating projections other than those just enumerated may also be present, but not all heatshields will have all types of nonpenatrating projections. Whatever nonpenetrating projections are present may or may not be radially high enough to contact the support shell.

As seen best in FIG. 4, the impingement film cooled combustor also has numerous impingement holes 58 perforating the support shell and numerous film holes 60 perforating the shields.

The support shell and heatshields are typically made of a nickel alloy, although not necessarily the same nickel alloy. In advanced combustors, the heatshield panels may be made of a suitable refractory material.

Figure 5:
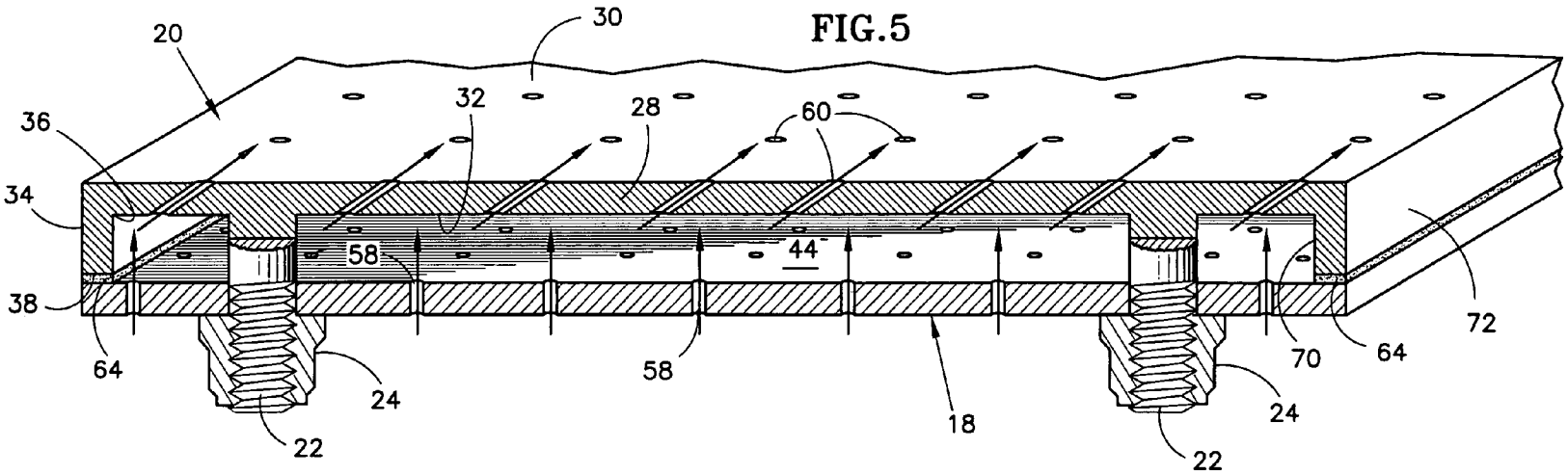
FIGS. 5–8 are perspective views of selected embodiments of the invention showing a support and a heatshield panel secured adjacent to the support.

FIGS. 5–8 illustrate four embodiments of the inventive heatshielded article. FIG. 5 shows a support represented by a support shell 18 for a turbine engine combustor. Heatshield 20 has a shield portion 28 with threaded studs 22 projecting from the cold side 32 of the shield and penetrating through openings in the shell. Nuts 24 secure the heatshield adjacent to the shell. A protective coating, not shown, coats the hot side 30 of the shield 28. The cold side 32 of shield 28 is uncoated. The heatshield also has a boundary wall 34 extending lengthwisely around the entire perimeter (i.e. around all four sides) of the shield. The boundary wall has an origin 36 at the shield portion of the heatshield and a terminus 38 remote from the shield. The terminus includes a protective coating 64 along the entire length of the wall so that the coating establishes a contact interface between the heatshield 20 and the shell 18. As used herein, "terminus" refers to the tip of the wall, as distinct from the sides 70, 72 of the wall near the tip, although some incidental amount of coating may be present in regions 70, 72 due to imprecisions inherent in the coating application process. In the embodiment of FIG. 5, the coated wall cooperates with the shell to form a coolant chamber 44 which, except for the impingement holes 58 and film holes 60, is substantially sealed.

Figure 6:
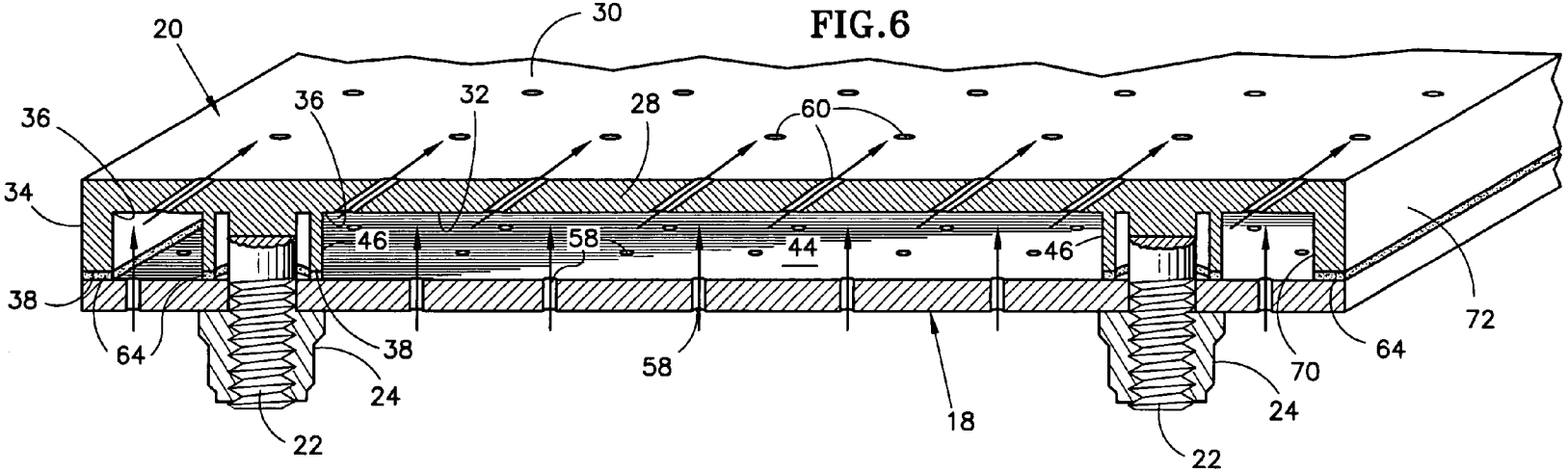

FIG. 6 shows an embodiment similar to FIG. 5, but with a collar 46 circumscribing each stud. The collar, like the boundary wall 34, is a nonpenetrating projection having an origin 36 and a terminus 38. The collar terminus includes a protective coating 64 that establishes a contact interface between the heatshield 20 and the shell 18.

Figure 7:
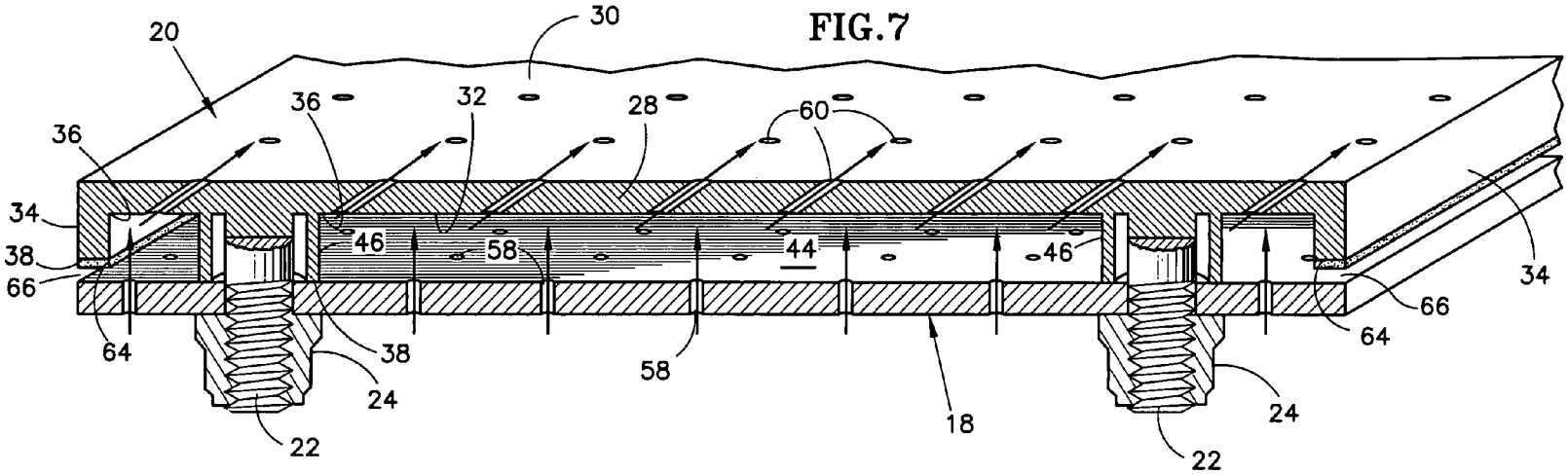

FIG. 7 shows yet another embodiment of the invention. Collars 46 circumscribe each stud and project radially far enough to contact the shell, thus establishing the height of the coolant chamber 44. A foreshortened boundary wall 34 extends toward but does not contact the shell 18. The foreshortened wall leaves a space 66 through which some of the coolant in chamber 44 can be diverted, rather than discharging through the film holes 60. The wall terminus includes a protective coating 64 along its entire length, however no coating is present at the terminus of each collar. Such a configuration could be used if there were no concern about direct contact between the collar and the shell. The coating at the wall terminus has value as a way to easily adjust the size of the space 66 either during product development or in response to field experience. The heatshield manufacturer can easily revise the specifications that govern the thickness of the coating to either make the space 66 larger or smaller, or to close the space as in FIGS. 5 and 6. In addition, existing heatshields could be reoperated by applying additional coating to reduce the space 66 or by removing previously applied coating to expand the space 66.

Figure 8:
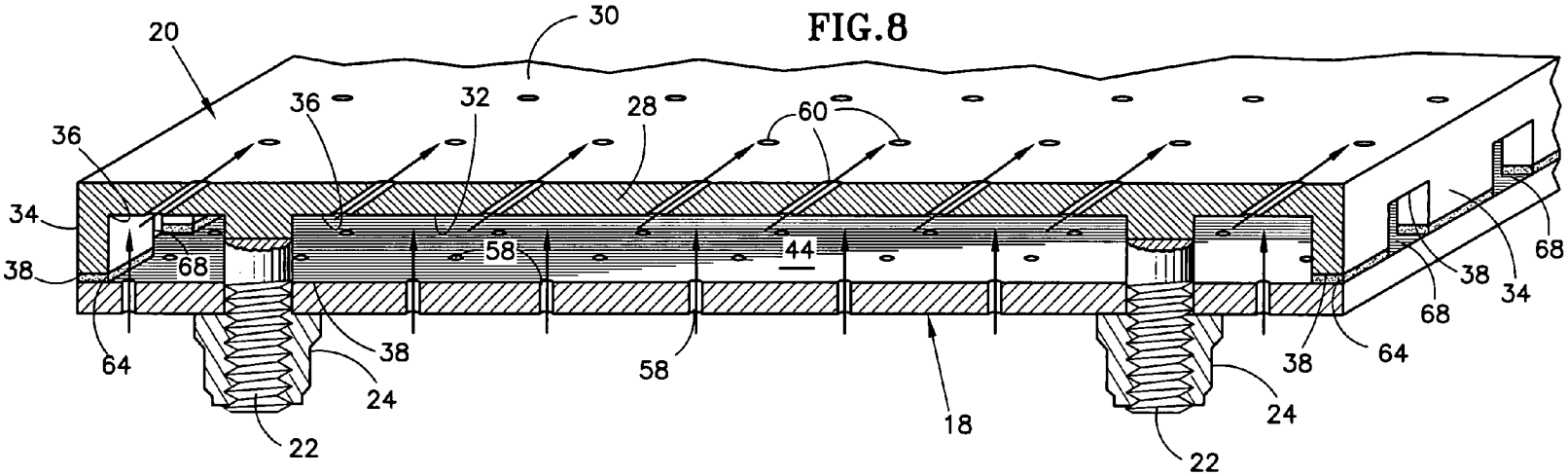

In FIGS. 5 through 7 the projection represented by boundary wall 34 has a terminus coating that extends the entire length of the wall. However other embodiments of the inventions may have a terminus coating along only part of the projection, for example along only part of the length of wall 34. For example, FIG. 8 shows a boundary wall whose contact with the shell is periodically interrupted to define a series of spaces 68 for diverting coolant from the chamber 44. A protective coating 64 is applied only to the portions of the wall where it is desired to establish a contact interface with the shell. No coating is present on the termini of the foreshortened wall portions.

The protective coating applied to the nonpenetrating projections is selected based on the particular requirements of the combustor. Typical coatings include oxidation resistant coatings, thermal barrier coatings and environmental barrier coatings. Oxidation resistant coatings are usually metallic coatings formulated to help prevent undesirable oxidation of a substrate. Examples of oxidation resistant coatings are described in U.S. Pat. Nos. 4,585,481, 4,861,618, and RE 32,121. Thermal barrier coatings comprise a ceramic material, such as yttria stabilized zirconia, applied directly to the substrate or, more commonly, applied over a metallic bond coat which itself may be an oxidation resistant coating. One example of a ceramic thermal barrier system is described in U.S. Pat. No. RE 33,876. Environmental barrier coatings are similar to thermal barrier and oxidation resistant coatings, but are comprised of materials such as mullite and silicon and are applied in such a way that they resist corrosion, erosion, recession, chemical reactions and moisture. Examples of environmental barrier coatings are described in U.S. Pat. Nos. 6,387,456 and 6,589,677.

This invention has been described and illustrated as it would be used in a gas turbine engine combustor, however it is equally beneficial in other applications. And although this invention has been shown and described with reference to a detailed embodiment thereof, it will be understood by those skilled in the art that various changes in form and detail may be made without departing from the invention as set forth in the accompanying claims.

I claim:

1. A heatshielded article, comprising:

a support;

at least one heatshield secured adjacent to the support;

the heatshield having a shield portion spaced from the support, the shield portion including a hot side and an uncoated cold side;

a projection projecting from the cold side, the projection having an origin at the shield portion and a terminus remote from the shield portion, the terminus being a tip of the projection as distinct from its sides; and a preselected a coating applied to the terminus along at least a portion of its length.

2. The article of claim 1 wherein impingement holes penetrate the support and film holes penetrate the heatshield.

3. The article of claim 1 wherein the preselected coating is selected from the group consisting of thermal barrier coatings, environmental barrier coatings and oxidation resistant coatings.

4. The article of claim 1 wherein the coated terminus contacts the support.

5. The article of claim 1 wherein the terminus has a length extending substantially parallel to the support, the terminus being spaced from the support over at least part of the length.

6. The article of claim 2, wherein the projection is at least one of a boundary wall, a rib, a collar, a radiator fin, a standoff, and a rim.

7. The article of claim 1 wherein the support and the heatshield are a support shell and a heatshield panel respectively for a gas turbine engine combustor.

8. A heatshield having a shield portion with a hot side and an uncoated cold side, a projection projecting from an origin at the cold side to a terminus remote from the cold side, the terminus being a tip of the projection as distinct from its sides, and a preselected coating applied to the terminus along at least a portion of its length.

* * * * *